US010219566B2

(12) United States Patent
Campbell

(10) Patent No.: US 10,219,566 B2
(45) Date of Patent: Mar. 5, 2019

(54) ADJUSTABLE BRA STRAP, BRASSIERE WITH ADJUSTABLE STRAPS, AND METHOD FOR ADJUSTING AND SECURING STRAPS

(71) Applicant: Sheila K. Campbell, Minturn, CO (US)

(72) Inventor: Sheila K. Campbell, Minturn, CO (US)

( * ) Notice: Subject to any disclaimer, the term of this patent is extended or adjusted under 35 U.S.C. 154(b) by 0 days.

(21) Appl. No.: 15/487,081

(22) Filed: Apr. 13, 2017

(65) Prior Publication Data

US 2017/0295877 A1 Oct. 19, 2017

Related U.S. Application Data

(60) Provisional application No. 62/324,112, filed on Apr. 18, 2016.

(51) Int. Cl.
*A41F 15/00* (2006.01)
*A41C 3/12* (2006.01)
*A41F 15/02* (2006.01)

(52) U.S. Cl.
CPC ..... *A41F 15/002* (2013.01); *A41C 3/12* (2013.01); *A41F 15/02* (2013.01)

(58) Field of Classification Search
CPC . A44B 11/04; Y10T 24/4088; Y10T 24/4093; Y10T 24/4098; A41F 15/002; A41F 15/02; A41C 3/12
USPC ..... 450/86
See application file for complete search history.

(56) References Cited

U.S. PATENT DOCUMENTS 1,920,549 A * 8/1933 Clark ..... A44B 11/04 24/200
2,084,412 A * 6/1937 Schaefer ..... A41F 15/00 24/186
2,099,199 A * 11/1937 Devendor ..... A44B 11/04 2/268
2,119,469 A * 5/1938 Kerngood ..... A44B 11/18 2/336
2,123,773 A * 7/1938 Eppink ..... A44B 11/04 2/244
2,189,574 A * 2/1940 Anderson ..... A44B 11/04 24/198
2,713,708 A * 7/1955 Auderson ..... A44B 11/04 24/198
3,214,815 A * 11/1965 Mathison ..... A44B 11/02 24/200
3,288,141 A * 11/1966 Mathison ..... A61F 13/72 24/200
3,313,300 A * 4/1967 Mathison ..... A61F 13/64 24/186
6,056,625 A * 5/2000 Fildan ..... A41F 15/002 2/336
2006/0230585 A1* 10/2006 Fildan ..... A44B 11/04 24/200
2012/0302135 A1* 11/2012 Solotoff ..... A41C 3/0028 450/52

(Continued)

*Primary Examiner* — Gloria Hale
(74) *Attorney, Agent, or Firm* — Snell & Wilmer L.L.P.

(57) ABSTRACT

Systems and methods for adjustable straps are disclosed. In various exemplary embodiments, adjustable slider-like mechanisms are configured with one or more protrusions for inserting through corresponding slits in a garment strap, for example a brassiere strap. In this manner, adjustable straps may be fixed in place and resist slippage, leading to improved wearer comfort and reducing or eliminating the need for regular adjustment.

14 Claims, 9 Drawing Sheets

(56) References Cited

U.S. PATENT DOCUMENTS

2016/0135513 A1* 5/2016 Solotoff ..... A41C 3/0028
450/52

* cited by examiner

100

900

ADJUSTABLE BRA STRAP, BRASSIERE WITH ADJUSTABLE STRAPS, AND METHOD FOR ADJUSTING AND SECURING STRAPS

CROSS-REFERENCE TO RELATED APPLICATIONS

This application claims priority to, and the benefit of, U.S. Provisional Application Ser. No. 62/324,112 filed on Apr. 18, 2016 and entitled "BRA STRAP SLIDER WITH KNOB", which is incorporated by reference in its entirety for all purposes.

TECHNICAL FIELD

The disclosure generally relates to brassieres, and more particularly, to adjustable straps for brassieres.

BACKGROUND

Brassieres (or "bras") with adjustable straps are a staple in everyday fashion. Because no person's body is the same, most brassieres currently include adjustable straps. These straps typically allow the wearer to adjust the straps to a desired length which prevents the strap from slipping down the wearer's shoulder throughout the day, provides added support to give breasts the lift desired and alleviate the stress on the back that can be caused by unsupported breasts. Prior approaches to adjustable straps often utilize a mechanism that allows the strap to double back on itself and relies on the friction created by the strap to keep the strap set at the desired length. Because of this, when worn throughout the day, the combination of gravity and the movement of the wearer usually provides enough force to overcome the friction and cause the strap to lengthen over time, resulting in poor fit and discomfort (and/or the need to regularly re-adjust the strap). Accordingly, improved systems and methods for adjustable bra straps are desirable.

In current prior approaches, a bra wearer may attempt to use safety pins, clips, or tape to prevent the lengthening of the bra strap over the day. In these approaches, the lengthening of the strap may still occur and may leave undesirable, visible lumps underneath the wearer's clothing.

SUMMARY

In an exemplary embodiment, an adjustable bra strap comprises at least one piece of fabric having a length, and an adjustment mechanism having at least one protrusion. The protrusion inserts through the at least one piece of fabric to fix the at least one piece of fabric in place with respect to the adjustment mechanism.

In another exemplary embodiment, a method for securing an adjustable bra strap in a desired position comprises adjusting the adjustable bra strap to a desired position, the adjustable bra strap comprising at least one piece of fabric having a length and an adjustment mechanism having a protrusion. The method further comprises inserting the protrusion through the at least one piece of fabric to fix the at least one piece of fabric in place with respect to the adjustment mechanism.

In another exemplary embodiment, a bra with adjustable straps comprise a pair of breast cups, a back closure connecting the pair of breast cups, and a pair of adjustable shoulder straps, one adjustable shoulder strap extending from a corresponding breast cup to the back closure. Each adjustable bra strap comprises at least one piece of fabric having a length, and an adjustment mechanism having a protrusion. The protrusion inserts through the at least one piece of fabric to fix the at least one piece of fabric in place with respect to the adjustment mechanism.

BRIEF DESCRIPTION OF THE DRAWINGS

A more complete understanding of principles of the present disclosure may be derived by referring to the detailed description and claims when considered in connection with the Figures, wherein like reference numbers refer to similar elements throughout the Figures, and where:

It should be appreciated by one of ordinary skill in the art that, while principles of the present disclosure are described with reference to the figures described above, such principles may also include a variety of embodiments consistent with the description herein. It should also be understood that, where consistent with the description, there may be additional components not shown in the system diagrams, and that such components may be arranged or ordered in different ways.

DETAILED DESCRIPTION

The detailed description shows embodiments by way of illustration, including the best mode. While these embodiments are described in sufficient detail to enable those skilled in the art to practice the principles of the present disclosure, it should be understood that other embodiments may be realized and that logical and mechanical changes may be made without departing from the spirit and scope of principles of the present disclosure. Thus, the detailed description herein is presented for purposes of illustration only and not of limitation. For example, the steps recited in any of the method descriptions may be executed in any order and are not limited to the order presented.

Moreover, for the sake of brevity, certain sub-components of individual components and other aspects of the system may not be described in detail herein. It should be noted that many alternative or additional functional relationships or physical couplings may be present in a practical system.

Such functional blocks may be realized by any number of components configured to perform specified functions.

In various embodiments, an adjustable strap may comprise a piece of fabric, an adjustment mechanism, and a protrusion where the strap is adjusted to a desired length via the adjustment mechanism and the protrusion is inserted through the piece of fabric to secure the strap in place, obviating the ability for straps to lengthen throughout the day.

Figure 1:
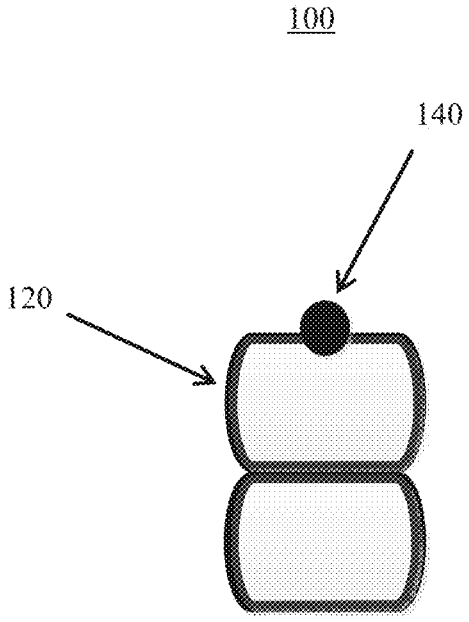
FIG. 1 illustrates an adjustment mechanism having a protrusion, in accordance with various embodiments.

With reference now to FIG. 1, in various embodiments, an adjustment mechanism 100 may comprise an adjuster 120 and at least one protrusion 140. The adjuster 120 may be configured to accept a piece of fabric, for example a strap. The protrusion 140 may be configured to insert through a piece of fabric in order to keep the piece of fabric at a desired length. In various embodiments, the adjuster 120 may be made of plastic. The adjuster 120 may be made of metal. It should be appreciated that an adjuster 120 may be made of any suitable material known in the art. The protrusion 140 may comprise a securing element, for example a knob, a button, a toggle, an alligator clip, a hook, a rotatable metal extender, a rotatable plastic extender, and/or a pin. Any other method of securing the piece of fabric in place can also be used. Moreover, in various embodiments, adjustment mechanism 100 may be configured absent adjuster 120.

In various embodiments, protrusion 140 may be aesthetically pleasing. Protrusion 140 may be shiny. Protrusion 140 may be decorated with glitter or other embellishments. Protrusion 140 may be selected to match the color of an associated brassiere. Moreover, protrusion 140 may be selected in a color to complement the brassiere. It should be appreciated that the protrusion 140 may be of any size, shape, or color desired, in order to at least partially retain a piece of fabric with respect to adjuster 120.

Figure 2:
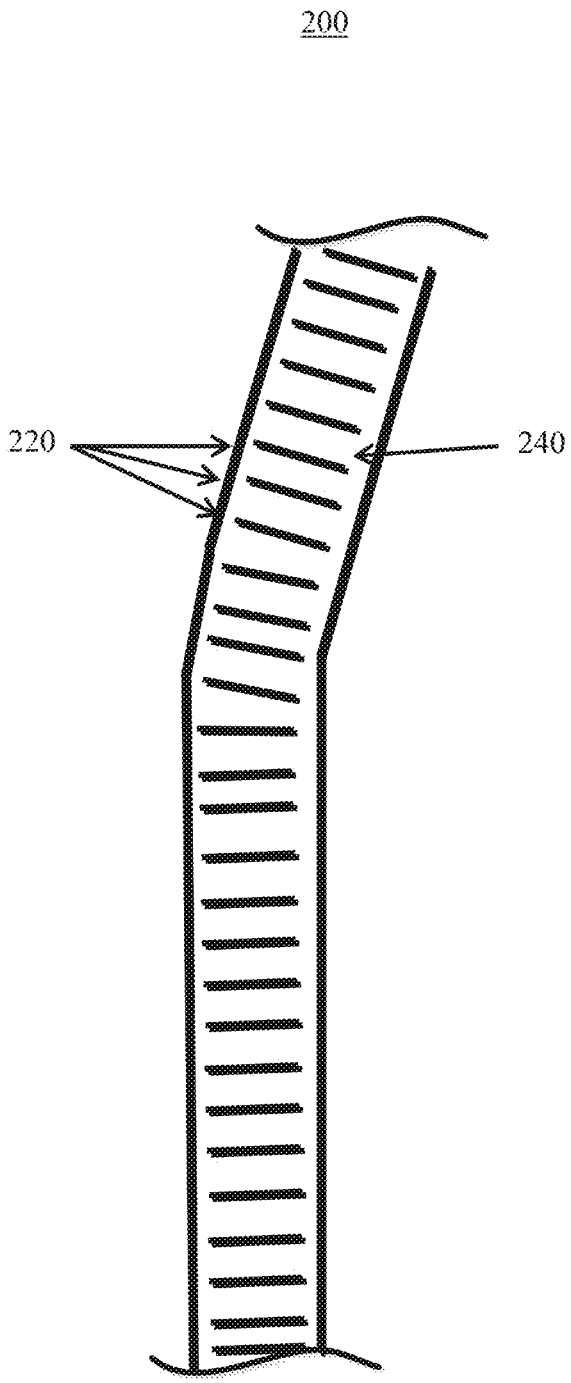
FIG. 2 illustrates a piece of fabric with a plurality of openings, in accordance with various embodiments.

Turning now to FIG. 2, and in accordance with various embodiments, a strap 200 may comprise a piece of fabric 240. The piece of fabric 240 may further comprise a plurality of openings 220. The piece of fabric 240 may further comprise a plurality of openings 220 along the entire length of the piece of fabric 240. The piece of fabric 240 may further comprise a plurality of openings 220 along a fraction of the length of the piece of fabric 240. In various embodiments, the piece of fabric 240 may further comprise a plurality of openings 220 along ¾ of the length of the piece of fabric 240. The piece of fabric 240 may further comprise a plurality of openings 220 along ⅝ of the length of the piece of fabric 240. The piece of fabric 240 may further comprise a plurality of openings 220 along about ½ of the length of the piece of fabric 240. In various embodiments, the piece of fabric 240 may further comprise a plurality of openings 220 along about ⅜ of the length of the piece of fabric 240. Moreover, the plurality of openings 220 may exist along any fraction of the length of the piece of fabric 240 desired. In various embodiments, there may be no openings in fabric 240.

Figure 3:
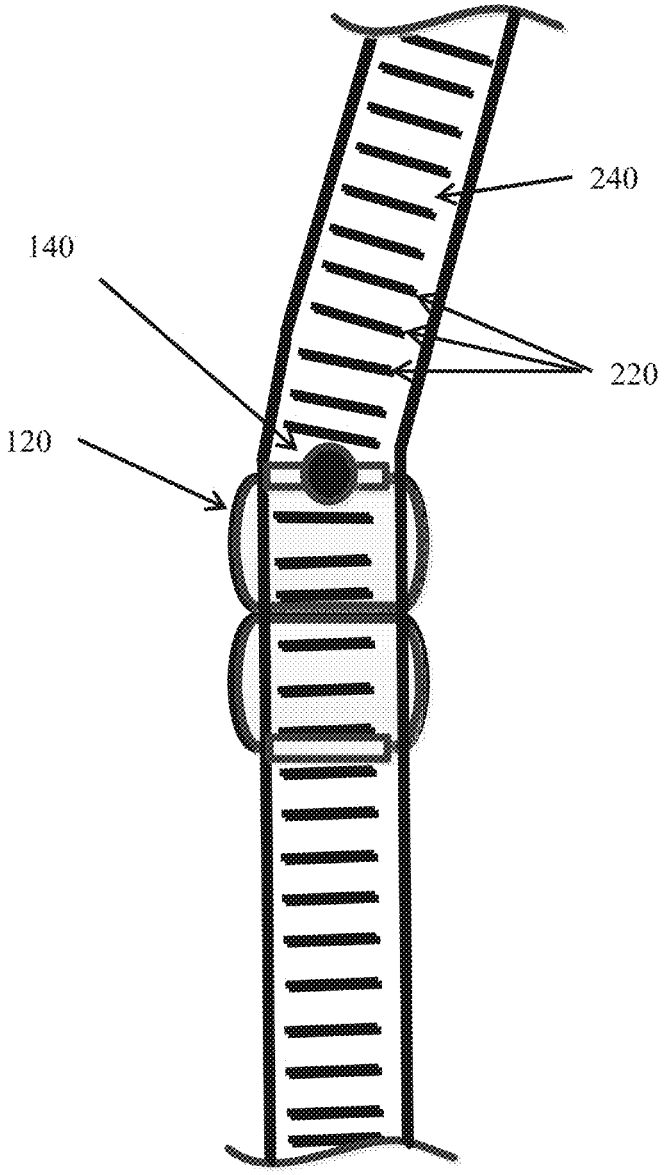
FIG. 3 illustrates a piece of fabric having a plurality of openings used with an adjustment mechanism having a protrusion, in accordance with various embodiments.
Figure 4A:
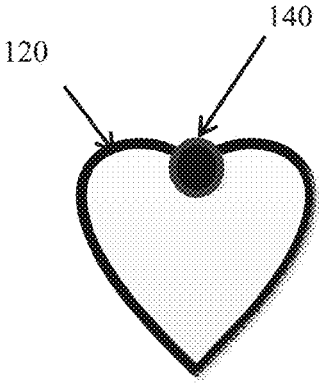
FIGS. 4A through 4F illustrate exemplary configurations of adjustment mechanisms having protrusions in the form of knobs, in accordance with various embodiments.
Figure 4B:
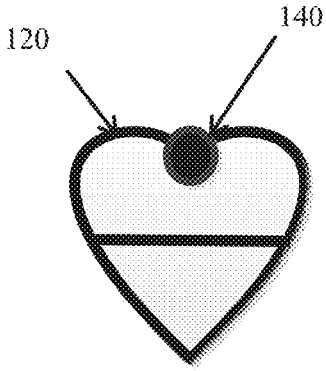
Figure 4C:
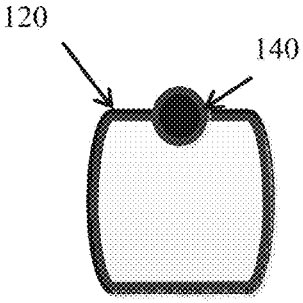
Figure 4D:
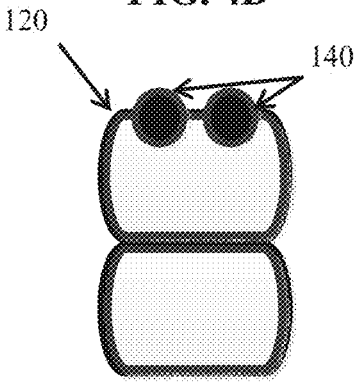
Figure 4E:
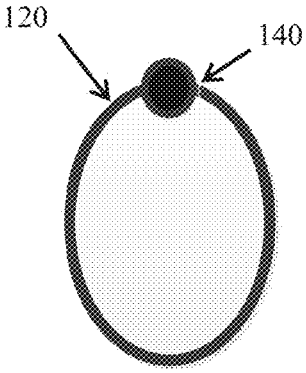
Figure 4F:
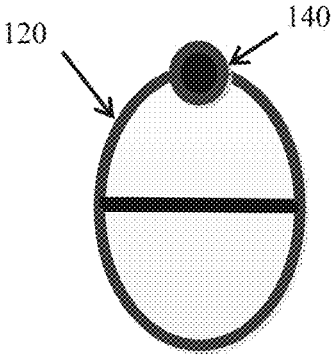
Figure 5A:
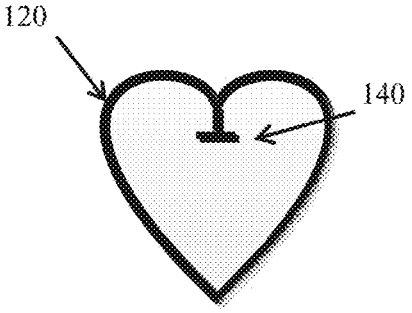
FIGS. 5A through 5E illustrate exemplary configurations of adjustment mechanisms having protrusions in the form of toggles, in accordance with various embodiments.
Figure 5B:
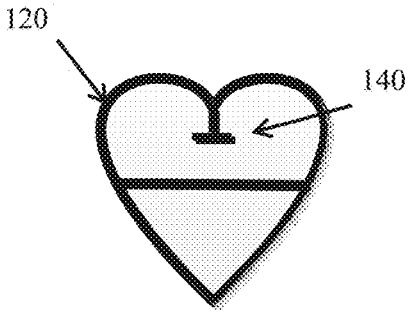
Figure 5C:
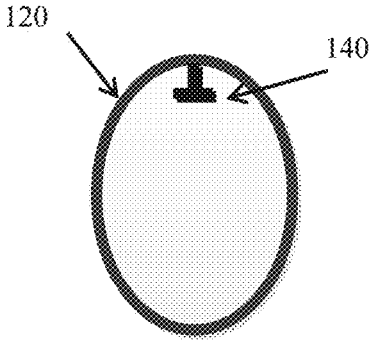
Figure 5D:
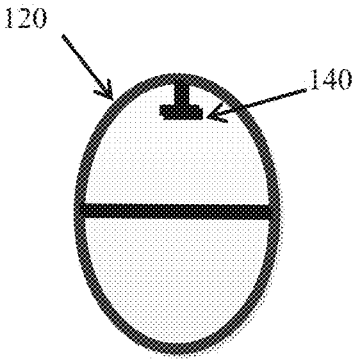
Figure 5E:
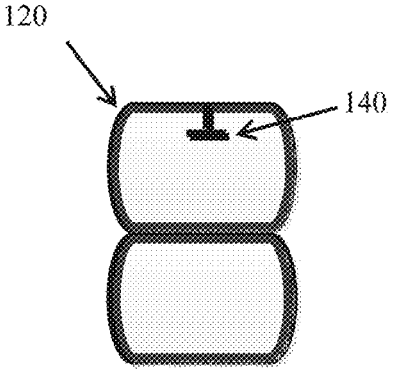

With reference now to FIG. 3, an adjustment mechanism comprising an adjuster 120 and a protrusion 140 may be configured to allow a piece of fabric 240 to enter the adjuster 120. The adjuster 120 may be configured to allow the piece of fabric 240 to be adjusted to a desired length. A protrusion 140 may be inserted through the piece of fabric 240 to secure the piece of fabric 240 at the desired length. Accordingly, the piece of fabric 240 may be configured with a plurality of openings 220 through which the protrusion 140 may be inserted.

In various embodiments, the plurality of openings 220 may be slits. The plurality of openings 220 may be ovular. The plurality of openings 220 may be rectangular. The plurality of openings 220 may be circular. The plurality of openings 220 may be horizontal. The plurality of openings 220 may be vertical. The plurality of openings 220 may be at an angle between 0 degrees and 180 degrees. The plurality of openings 220 may be at an angle between 0 degrees and 90 degrees. It should be appreciated that the plurality of openings 220 may be of any shape suitable and at any orientation to fit, accept, and/or at least partially receive the selected protrusion 140. In various embodiments, the plurality of openings 220 may be reinforced to prevent wear and tear from overuse of specific openings. For example, the plurality of openings 220 may be reinforced with extra stitching around the edge of each opening. In various embodiments, the plurality of openings 220 may be reinforced with extra material around the edge of the opening. Moreover, the plurality of openings 220 may be reinforced by utilizing a piece of fabric 240 having a sturdier fabric used than is typically used in bra straps.

Figure 9:
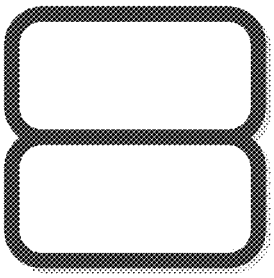
FIG. 9 illustrates a conventional bra strap adjuster as is known in the art.

With reference now to FIGS. 4A through 4F, exemplary embodiments of adjustment mechanisms comprising an adjuster 120 and a protrusion 140 in the form of a knob are depicted, in accordance with various embodiments. An adjuster 120 may be a variety of shapes. An adjuster 120 may be heart shaped, as in FIG. 4A and FIG. 4B. An adjuster 120 may be rectangular as in FIG. 4C. An adjuster 120 may be oval-shaped as in FIG. 4E and FIG. 4F. Moreover, an adjuster 120 may be any desired shape through which a piece of fabric may fit. In various embodiments the adjuster 120 may be split by a bar. However, in various exemplary embodiments adjuster 120 may be configured without a central bar or divider. Additionally, with momentary reference to FIG. 9, the adjuster 120 may be in the shape of a typical bra strap adjuster 900.

FIGS. 5A through 5E illustrate exemplary embodiments of adjustment mechanisms that may comprise an adjuster 120 and a protrusion 140 in the form of a disc, toggle, bar, or extension, in accordance with various embodiments. In these exemplary embodiments, protrusion 140 may be configured with one or more edges, flanges, extensions, protrusions, rotatable mechanisms, and/or the like in order to resist protrusion 140 from inadvertently separating from an associated opening 220 through which it has been passed.

Figure 6:
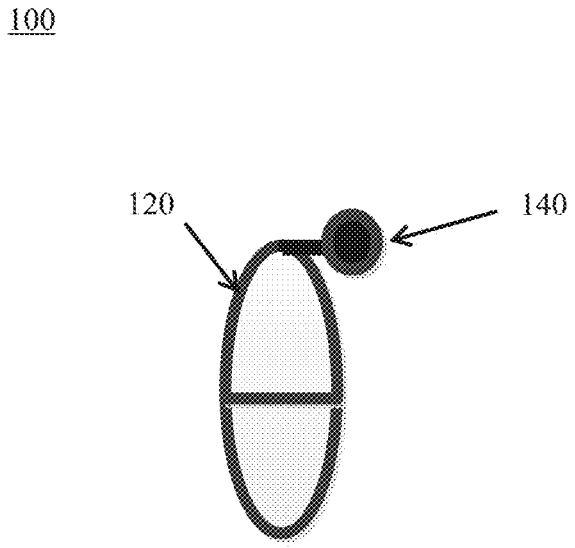
FIG. 6 illustrates a perspective view of an attachment mechanism having a protrusion, in accordance with various embodiments.

FIG. 6 illustrates a perspective view of an exemplary embodiment of an adjustment mechanism 100 with a protrusion 140. In various embodiments, as depicted, a protrusion 140 may be raised from the plane of the adjuster 120. In various embodiments, a protrusion 140 may be perpendicular to the plane of the adjuster 120. In various embodiments, a protrusion 140 may lay flat relative to the plane of the adjuster 120. Moreover, the protrusion 140 may lay at any angle relative to the plane of the adjuster 120 in order to interface with, pass through, be retained within, and/or separate from an associated opening 220. In various embodiments, a protrusion 140 may be located near a top side of the adjuster 120. In various embodiments, a protrusion 140 may be located near a bottom side of the adjuster 120. In various embodiments, a protrusion 140 may be located near a left side of the adjuster 120. In various embodiments, a protrusion 140 may be located near a right side of the adjuster 120. Moreover, the protrusion 140 may be located at any place along the adjuster in order to interface with, pass through, be retained within, and/or separate from an associated opening.

Figure 7A:
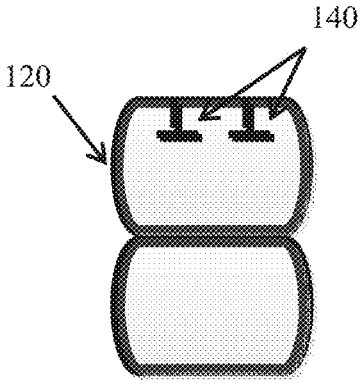
FIGS. 7A and 7B illustrate exemplary configurations of adjustment mechanisms having multiple protrusions, in accordance with various embodiments.
Figure 7B:
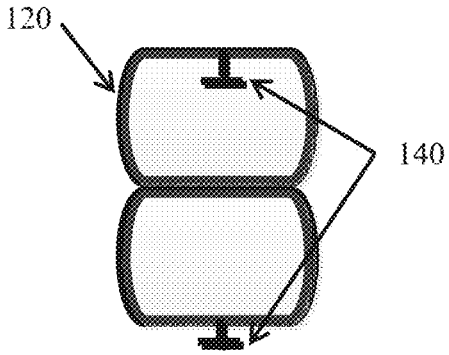

Turning now to FIGS. 7A and 7B, in various embodiments, an adjustment mechanism 100 may comprise an adjuster 120 and at least one protrusion 140. In accordance with various embodiments, there may be multiple protrusions 140 attached to the adjuster 120. There may be two protrusions 140. There may be three protrusions 140. In various embodiments, there may be between four and six protrusions 140. Moreover, there may be any suitable number of protrusions 140 on adjustment mechanism 100, as desired.

Figure 8:
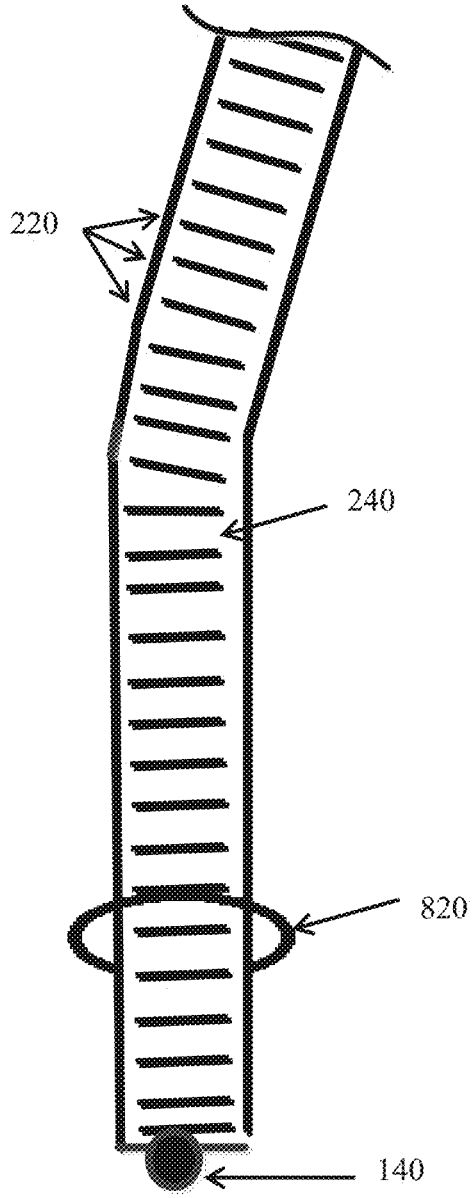
FIG. 8 illustrates a piece of fabric having a plurality of openings and a protrusion on the end of the piece of fabric where the piece of fabric is fed through a ring, in accordance with various embodiments.

With reference now to FIG. 8, a piece of fabric 240 may enter a holder 820 and have a protrusion 140 on an end of the piece of fabric 240, in accordance with various embodiments. The piece of fabric 240 may be doubled back on itself over the holder 820 and be secured at a desired length by inserting the protrusion 140 through a slit or other opening 220 in the piece of fabric 240. In accordance with various embodiments, the piece of fabric 240 may further comprise a plurality of openings 220 through which the protrusion 140 may be inserted. In various embodiments, the holder 820 may be affixed to a second piece of fabric 240, or the holder 820 may be affixed to the rest of a brassiere. The holder 820 may be configured as a ring. Holder 820 may be a square. Holder 820 may be a rectangle. Moreover, holder 820 may be configured with any shape that allows the piece of fabric 240 to pass through it.

In various embodiments, an adjustable strap and/or adjustment mechanism as disclosed herein may be utilized in connection with a brassiere. In this manner, lengthening of the strap from a desired adjusted length due to wearing of the garment throughout the day may be reduced and/or eliminated.

In various embodiments of use, the protrusion may fit through fabric on a portion of the brassiere other than the strap, allowing an adjustment to be made to the length of the strap without requiring the added bulk of an adjuster. In such an embodiment, the excess length of the strap may be trimmed after it has been secured in the desired length. In various embodiments, the protrusion may fit through fabric on a portion of the clothing meant to be worn over the brassiere. Moreover, clothing worn over the brassiere may have a plurality of openings through which the protrusion may be inserted. Additionally, clothing worn over the brassiere may have a plurality of holders affixed on the inside of the clothing through which the protrusion may be inserted. It should be appreciated that the protrusion may be inserted through any garment (under a brassiere, as part of a brassiere, and/or over a brassiere) configured to receive such a protrusion in order to retain a strap in place, in accordance with various embodiments.

In various embodiments, the adjustment mechanism of one strap may be used to couple the strap to another strap (for example, drawing two shoulder straps together to join them in an area roughly between the shoulder blades), forming a different type of multiple strap pattern that may be desirable based on the chosen clothing.

Principles and features of the present disclosure may suitably be combined with the subject matter of adjustable breast support garments, for example as disclosed in U.S. Pat. No. 9,332,789 issued May 10, 2016 entitled "Adjustable Breast Support Garment" which is incorporated herein by reference in its entirety for all purposes.

Principles and features of the present disclosure also may suitably be combined with the subject matter of adjustable breast support garments, for example as disclosed in U.S. Pat. No. 8,545,287 issued Oct. 1, 2013 entitled "Adjustable Breast Support Garment" which is incorporated herein by reference in its entirety for all purposes.

Principles and features of the present disclosure also may suitably be combined with the subject matter of adjustable breast support garments, for example as disclosed in U.S. Pat. No. 8,500,513 issued Aug. 6, 2013 entitled "Adjustable Breast Support Garment" which is incorporated herein by reference in its entirety for all purposes.

While the components and steps outlined herein represent embodiments of principles of the present disclosure, practitioners will appreciate that there are a variety of physical structures and interrelated roller shade components that may be applied to create similar results. The steps are presented for the sake of explanation only and are not intended to limit the scope of the present disclosure in any way. Benefits, other advantages, and solutions to problems have been described herein with regard to specific embodiments. However, the benefits, advantages, solutions to problems, and any element(s) that may cause any benefit, advantage, or solution to occur or become more pronounced are not to be construed as critical, required, or essential features or elements of any or all of the claims.

Exemplary systems and methods are disclosed. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described. After reading the description, it will be apparent to one skilled in the relevant art(s) how to implement principles of the disclosure in alternative embodiments.

It should be understood that the detailed description and specific examples, indicating embodiments, are given for purposes of illustration only and not as limitations. Many changes and modifications may be made without departing from the spirit thereof, and principles of the present disclosure include all such modifications. Corresponding structures, materials, acts, and equivalents of all elements are intended to include any structure, material, or acts for performing the functions in combination with other elements. Reference to an element in the singular is not intended to mean "one and only one" unless explicitly so stated, but rather "one or more." Moreover, when a phrase similar to "at least one of A. B, or C" or "at least one of A, B, and C" is used in the claims or the specification, the phrase is intended to mean any of the following: (1) at least one of A; (2) at least one of B; (3) at least one of C; (4) at least one of A and at least one of B; (5) at least one of B and at least one of C; (6) at least one of A and at least one of C; or (7) at least one of A, at least one of B, and at least one of C.

What is claimed is:

1. An adjustable bra strap, comprising:

a first piece of fabric forming a portion of a shoulder strap for a bra; and an adjustment mechanism, comprising:

a first loop defining a first aperture;

a second loop defining a second aperture, the second loop and the first loop being joined by a central bar disposed therebetween; and a protrusion extending from the first loop at a location opposite the central bar, wherein the first piece of fabric passes through the first aperture in a first direction, passes behind the central bar, and then passes through the second aperture in a second direction, and wherein the protrusion inserts through a slit in the first piece of fabric to releasably fix the first piece of fabric in place with respect to the adjustment mechanism.

2. The adjustable bra strap of claim 1, further comprising a second piece of fabric coupled to the adjustment mechanism.

3. The adjustable bra strap of claim 1, wherein the first piece of fabric and the second piece of fabric are releasably connectable by the adjustment mechanism.

4. The adjustable bra strap of claim 3, wherein the protrusion comprises a ball shape.

5. The adjustable bra strap of claim 1, wherein the first piece of fabric is configured with a plurality of slits spaced at regular intervals.

6. The adjustable bra strap of claim 5, wherein the protrusion is insertable through at least one of the plurality of slits to releasably fix the first piece of fabric in place with respect to the adjustment mechanism.

7. The adjustable bra strap of claim 1, wherein the protrusion comprises a button.

8. The adjustable bra strap of claim 1, wherein the adjustment mechanism is a holder affixed on the inside of an item of clothing worn over the bra.

9. A method for securing an adjustable bra strap in a desired position, the method comprising:

adjusting the adjustable bra strap to a desired position, the adjustable bra strap comprising:

a first piece of fabric forming a portion of a shoulder strap for a bra; and an adjustment mechanism, comprising:

a first loop defining a first aperture;

a second loop defining a second aperture, the second loop and the first loop being joined by a central bar disposed therebetween; and a protrusion extending from the first loop at a location opposite the central bar, wherein the first piece of fabric passes through the first aperture in a first direction, passes behind the central bar, and then passes through the second aperture in a second direction; and inserting the protrusion through a slit in the first piece of fabric to releasably fix the first piece of fabric in place with respect to the adjustment mechanism.

10. The method of claim 9, further comprising inserting the protrusion through a holder affixed on the inside of an item of clothing worn over the bra.

11. The method of claim 9, wherein the adjustable bra strap is a first shoulder strap of a bra having a first shoulder strap and a second shoulder strap, and wherein the method further comprises inserting the protrusion through a slit in the second shoulder strap to draw the first shoulder strap and the second shoulder strap together in an area roughly between the shoulder blades of the wearer of the bra.

12. A bra with adjustable straps, the bra comprising:

a pair of breast cups;

a back closure connecting the pair of breast cups; and a pair of adjustable shoulder straps, one adjustable shoulder strap extending from a corresponding breast cup to the back closure, wherein each adjustable bra strap comprises:

a first piece of fabric; and an adjustment mechanism, comprising:

a first loop defining a first aperture;

a second loop defining a second aperture, the second loop and the first loop being joined b a central bar disposed therebetween; and a protrusion extending from the first loop at a location opposite the central bar, wherein the first piece of fabric passes through the first aperture in a first direction, passes behind the central bar, and then passes through the second aperture in a second direction, and wherein the protrusion inserts through a slit in the first piece of fabric to releasably fix the first piece of fabric in place with respect to the adjustment mechanism.

13. The bra of claim 12, wherein the first piece of fabric is configured with a plurality of slits spaced at regular intervals.

14. The bra of claim 13, wherein the protrusion is insertable through at least one of the plurality of slits in order to releasably couple the first piece of fabric to the adjustment mechanism.

* * * * *